US007331831B2

(12) United States Patent
Cvasa

(10) Patent No.: US 7,331,831 B2
(45) Date of Patent: Feb. 19, 2008

(54) ELECTRICAL CONNECTOR WITH A BIFURCATED CONTACT

(75) Inventor: Eduard Cvasa, Bochum (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/595,663

(22) Filed: Nov. 10, 2006

(65) Prior Publication Data

US 2007/0105422 A1 May 10, 2007

(30) Foreign Application Priority Data

Nov. 10, 2005 (EP) ..... 05024554

(51) Int. Cl.
*H01R 11/20* (2006.01)

(52) U.S. Cl. ..... 439/857

(58) Field of Classification Search ..... 439/395, 439/396, 849, 850, 857
See application file for complete search history.

(56) References Cited

U.S. PATENT DOCUMENTS 2,490,631 A 12/1949 Johansson
5,868,590 A * 2/1999 Dobbelaere ..... 439/839
5,957,734 A 9/1999 Gladd et al.
6,027,361 A * 2/2000 Burmeister et al. ..... 439/395
6,361,352 B2 * 3/2002 Barrat et al. ..... 439/395
6,572,419 B2 * 6/2003 Feye-Homann ..... 439/839

FOREIGN PATENT DOCUMENTS

DE 2237064 2/1974
WO WO/03/028158 4/2003

* cited by examiner

*Primary Examiner*—Neil Abrams
*Assistant Examiner*—Phuongchi Nguyen
(74) *Attorney, Agent, or Firm*—David P. Wood

(57) ABSTRACT

An electrical connection device comprises a bifurcated contact to establish an electrical connection with a mating contact, the bifurcated contact having at least two limbs, at least one web region between the limbs, and an electrically conductive jacket that is in contact with said web region. The bifurcated contact includes a region wherein the jacket at least partially surrounds the two limbs, which provide a plurality of contact positions within the jacket.

19 Claims, 4 Drawing Sheets

ELECTRICAL CONNECTOR WITH A BIFURCATED CONTACT

TECHNICAL FIELD

The invention relates to an electrical connection device comprising a bifurcated contact for the establishing of an electrical connection with a mating contact.

BACKGROUND OF THE INVENTION

Bifurcated contacts, that is contacts with two contact limbs or contact sections which can be arranged, for example, in an upright or horizontal manner, frequently serve for the establishing of an electrical connection and a mechanical connection with a tongue-like mating contact. In this arrangement, this mating contact can, for example, be associated with a relay, a fuse and/or the like. The limited current carrying capacity due to the increased heat development in the bifurcated contact is disadvantageous with such a connection. Conventional solutions which make up for this disadvantage result in a larger construction height.

SUMMARY OF THE INVENTION

It is the underlying object of the invention to provide an improved electrical connection device of the initially named kind with which the aforesaid disadvantages have been eliminated.

This object is satisfied in accordance with the invention in that the bifurcated contact is provided with an electrically conductive jacket which is in particular in contact with the web region of the bifurcated contact, on the one hand, and has contact positions with the mating contact in those regions in which it surrounds the two limbs of the bifurcated contact, on the other hand.

The possibility now exists due to this design of providing the bifurcated contact with an electrically conductive jacket which provides an additional current path without enlarging the constructional height and thus reduces the generation of heat. This electrically conductive jacket can also comprise two limb-like sections, for example, just like the bifurcated contact. A further current path can therefore be provided, for example, with the electrically conductive jacket between a relay contact and a central electrical interface, for example, which was not possible with the previously usual additional sleeve of stainless steel to increase the normal contact force. The circumstance can thus therefore in particular also be taken into account that different load currents can occur in the central electrical system. Since the constructional height is not enlarged by the electrically conductive jacket, additional costs are saved. Advantages also result with respect to the respective installation situation with the small constructional height.

Additional contact points to the mating plug of, for example, a relay or a fuse are therefore produced with the electrically conductive jacket without enlarging the constructional height, and indeed with the positive effect of a reduction of the heat development in the central electrical system and of improved current carrying capacity. The electrically conductive jacket forms an additional bridge between the mating piece such as a relay or a fuse and, for example, a conductor rail to which the bifurcated contact can be connected.

In accordance with a preferred practical embodiment of the electrical connection device, the jacket for the forming of the contact points with the mating contact is provided with shoulders which project from the regions of the jacket surrounding the two limbs of the bifurcated contact into a gap lying therebetween and receiving the mating contact.

The gap of the jacket is expediently aligned with the gap of the bifurcated contact.

The jacket preferably has at least two respective shoulders coming into contact with the mating contact at each side of its gap. In this arrangement, two respective shoulders of the jacket coming into contact with the mating contact are advantageously disposed opposite one another.

In a preferred practical embodiment of the electrical connection device, the jacket for the forming of the contact positions with the mating contact is provided with four shoulders of which two are disposed opposite one another in each case.

The jacket is preferably provided with corresponding shoulders in the region of the free ends of the two limbs of the bifurcated contact.

The jacket is expediently formed starting from a slit flat part with a base section and an elongate section extending away from it, with the elongate section being bent around the free limb ends of the bifurcated contact and the base section being bent laterally around the web region of the bifurcated contact.

The jacket is preferably formed by a stamped part.

It is also in particular of advantage for the elongate section of the jacket bent around the free limb ends of the bifurcated contact to extend at its free end up to and into the web region of the bifurcated contact. It is of advantage here for the base section of the jacket bent laterally around the web region of the bifurcated contact to at least partly cover the region of the free end of its elongate section bent around the free limb ends of the bifurcated contact.

The base section of the jacket expediently extends beyond the height of the plug-in region of the cable contact over a specific region of the two limbs of the bifurcated contact. It is of advantage here for the base section of the jacket bent around the web region of the bifurcated contact and regionally over its two limbs to cover the elongate section bent around the free limb ends of the bifurcated contact.

In a preferred practical embodiment, the jacket consists of a copper plastic alloy. The jacket should preferably have good electrical conductivity and good thermal relaxation stability.

In accordance with a preferred practical embodiment, the jacket preferably formed starting from a flat part or a stamped part has a material thickness in a range from approximately 0.4 mm.

The bifurcated contact can also expediently have a material thickness in a range from approximately 0.8 mm.

As already mentioned, the bifurcated contact is expediently connected to a conductor rail.

BRIEF DESCRIPTION OF THE DRAWINGS

The invention will be explained in more detail in the following with reference to an embodiment and to the drawing; there are shown.

DESCRIPTION OF THE PREFERRED EMBODIMENT

Figure 1:
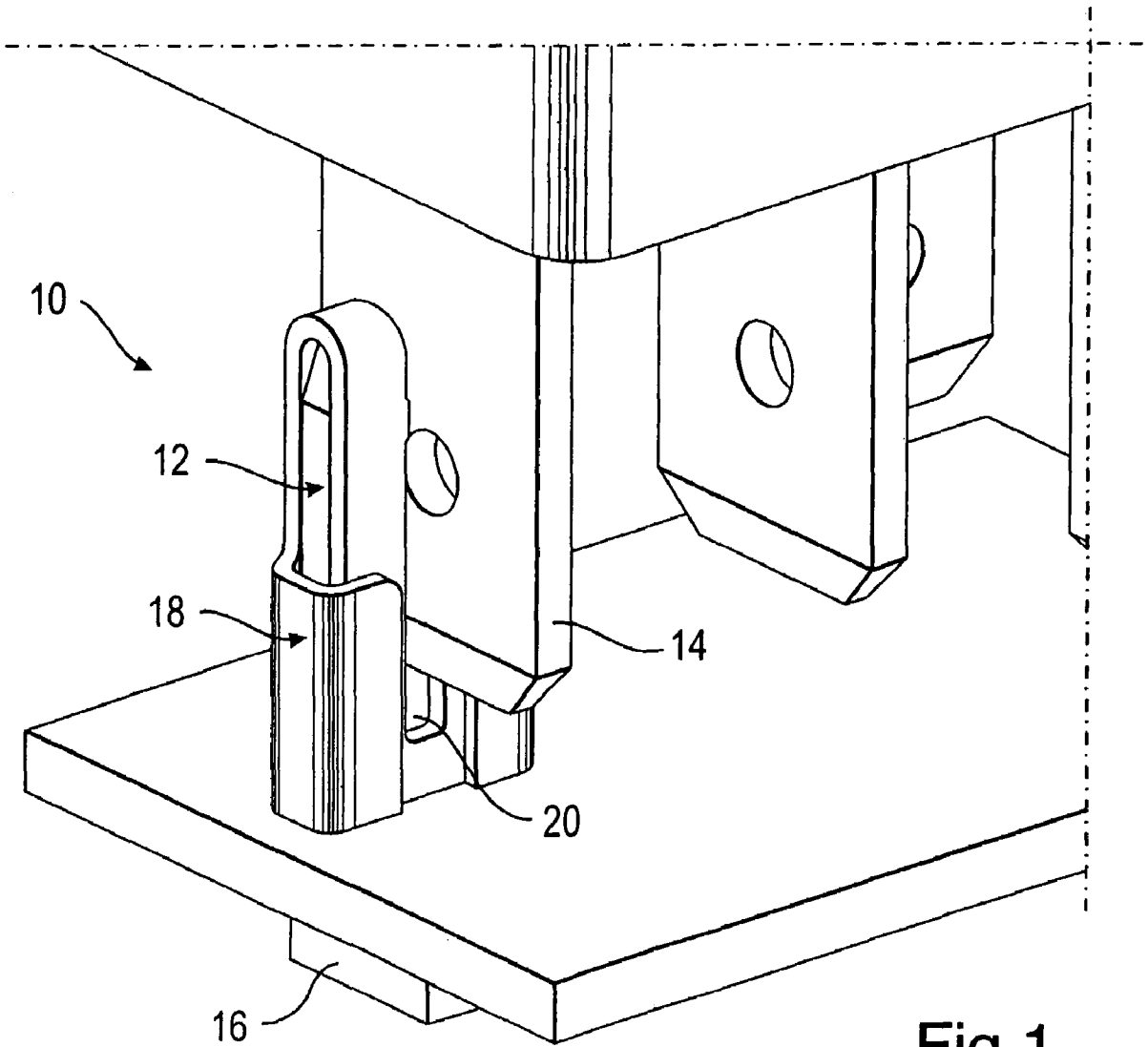
FIG. 1 is a schematic perspective representation of an electrical connection device having a bifurcated contact to establish an electrical connection with a mating contact.

FIG. 1 shows in a schematic perspective representation an electrical connection device 10 comprising a bifurcated contact 12 to establish an electrical connection with a mating contact 14.

The cable contact 12 can be connected to a current conductor 16. The mating contact 14, for example of tongue form in the present case, can be associated, for example, with a relay, a fuse or the like.

The bifurcated contact 12 is provided with an electrically conductive jacket 18. This jacket 18 can in particular be in contact with the web region 20 of the bifurcated contact 12 (cf. e.g. the contact regions 38 in FIG. 3), on the one hand, whereas, in the regions in which it surrounds the two limbs 22 (cf. in particular FIG. 2) of the bifurcated contact 12, it has contact positions with the mating contact 14, on the other hand, which are formed in the present case by shoulders 24 (cf. in particular FIG. 2 again).

Figure 2:
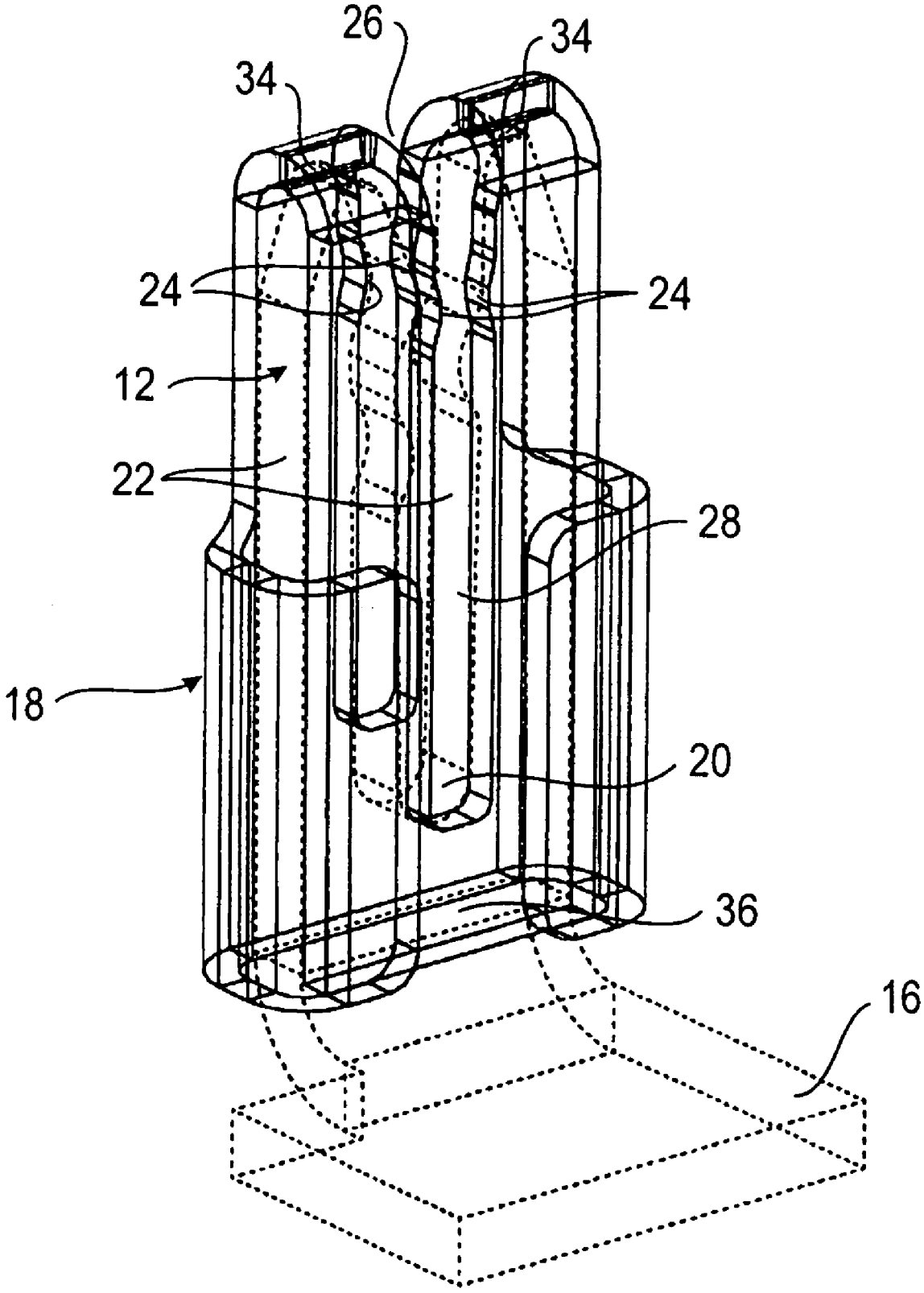
FIG. 2 is a schematic perspective view of the bifurcated contact shown in FIG. 1 with an associated jacket.

In FIG. 2, the bifurcated contact 12 recognizable in FIG. 1 with the associated electrically conductive jacket 18 is shown again in a schematic perspective representation. In the present case, the mating contact has been omitted for reasons of clarity.

The electrically conductive jacket 18 is therefore provided with shoulders 24 to form the contact positions with the mating contact 14 (cf. FIG. 1). As can in particular be recognized with reference to FIG. 2, these shoulders 24 are directed—starting from the regions of the jacket 18 surrounding the two limits 22 of the bifurcated contact 12 into the gap 26 lying therebetween and accepting the mating contact 14 (cf. FIG. 1).

In this arrangement, this gap 26 of the jacket 18 is aligned with the gap 28 of the bifurcated contact 12.

As can in particular again be recognized with reference to FIG. 2, in the present case the jacket 18 has in each case at least two shoulders 24 coming into contact with the mating contact 14 (cf. FIG. 1) on each side of its gap 26. In this arrangement, two respective shoulders 24 of the jacket 18 entering into contact with the mating contact 14 are disposed opposite one another.

In the present embodiment, the jacket 18 is provided with precisely four shoulders 24 to form the contact positions with the mating contact 14, of which, as already mentioned, two respective ones are disposed opposite one another. The jacket 18 is provided in the region of the free ends of the two limbs 22 of the bifurcated contact 12 with the respective shoulders 24.

Figure 4:
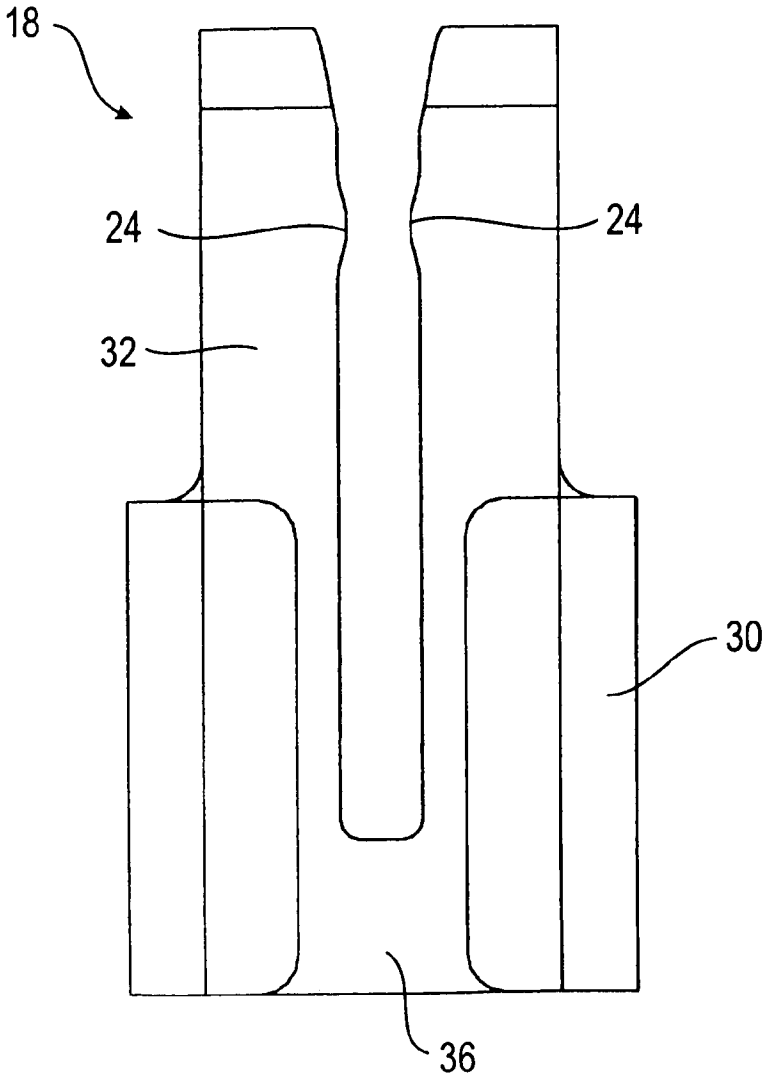
FIG. 4 is a schematic front view of the jacket bent into its final form.
Figure 3:
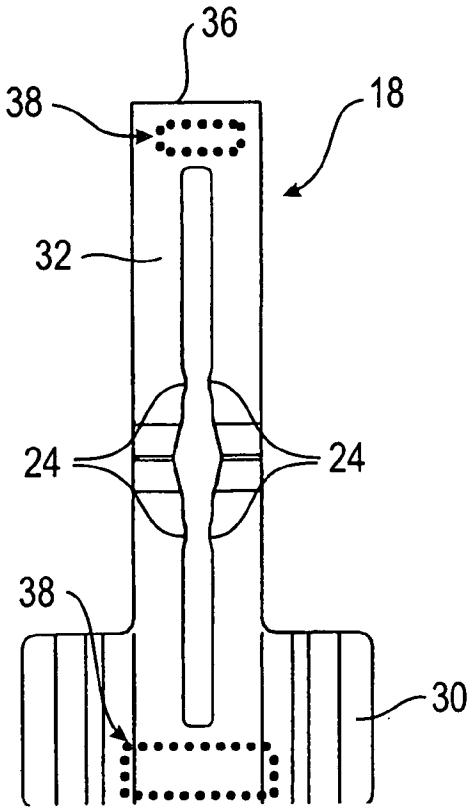
FIG. 3 is a development of the jacket formed starting from a flat part or stamped part.
Figure 6:
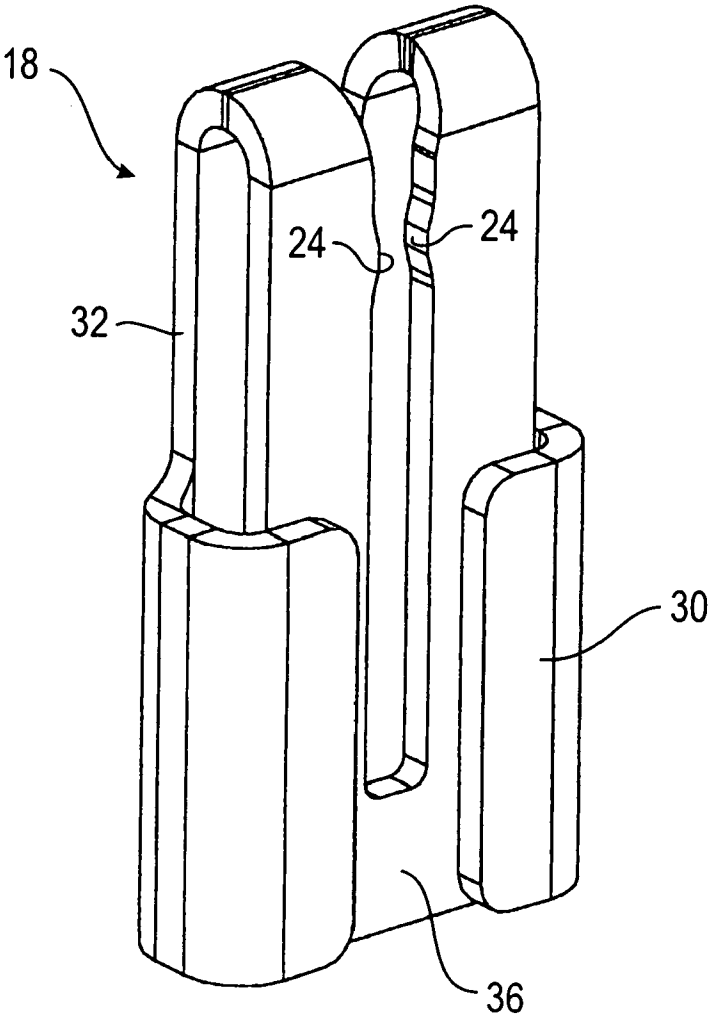
FIG. 6 is a schematic perspective view of the jacket.
Figure 5:
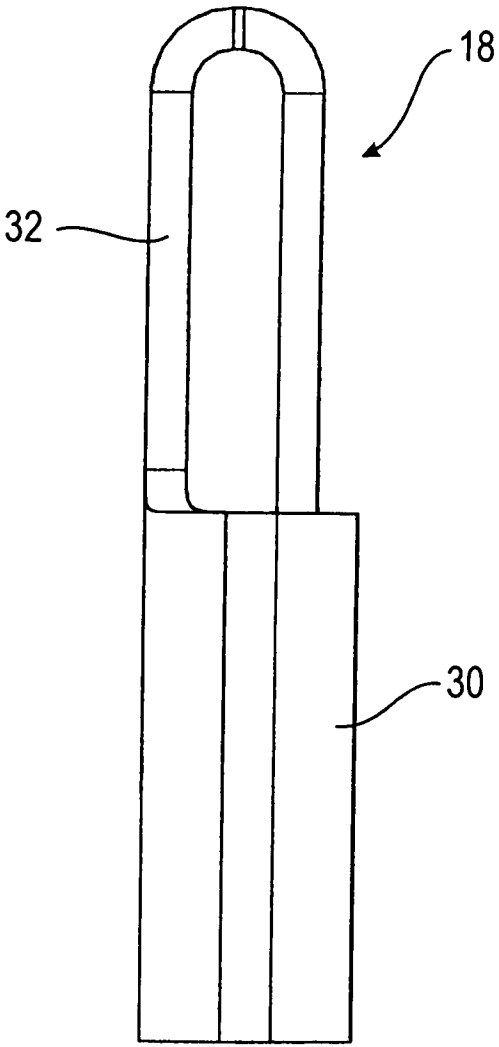
FIG. 5 is a schematic side view of the jacket bent into its final form.

FIG. 3 shows a development of the jacket 18 formed starting from a flat part or stamped part. In FIG. 4, the jacket 18 bent into its final shape is reproduced in a schematic front view. FIG. 5 shows the jacket 18 bent into its final shape in a schematic side view. FIG. 6 shows the jacket 18 bent into its final shape in a schematic perspective view again.

As can be seen from FIGS. 3 to 6, the jacket 18 can be formed, in particular starting from a slit flat part with a base part 30 that includes a slitless base section and an elongate slit section 32 extending away from the base part. The elongate section 32 is bent around the free limb ends 34 of the bifurcated contact 12 (of also FIG. 2) and the base part that includes the slitless base section is bent laterally around the web region 20 of the bifurcated contact 12.

The elongate section 32 of the jacket 18 bent around the free limb ends 34 of the bifurcated contact 12 extends with its free end 36 up to and into the region of the web 20 of the bifurcated contact 12 (cf. also again FIGS. 1 and 2). In the present case, this free end 36 of the bent over elongate section 32 of the jacket 18 ends contingently with the lower edge of the base section 30 (cf. in particular FIGS. 4 and 6).

As can again in particular be recognized with reference to FIGS. 4 and 6, the base section 30 of the jacket 18 bent laterally around the web region of the bifurcated contact 12 at least partly covers the region of the free end 36 of its elongate section 32 bent downwardly around the free limb ends 34 of the bifurcated contact 12.

In the present case, the base section 30 of the jacket 18 extends beyond the height of the web region of the bifurcated contact 12 over a specific region of the two limbs 22 of the bifurcated contact 12.

The base section 30 of the jacket 18 bent laterally around the web region of the bifurcated contact 12 and regionally over its two limbs 22 also covers—over a corresponding length—the elongate section 30 bent around the free limb ends 34 of the bifurcated contact 12 (cf. also FIG. 2 again).

The jacket 18 can advantageously consist of a copper plastic alloy with good electrical conductivity and a good thermal relaxation stability.

The jacket 18 formed in the present case starting from a flat part or stamped part preferably has a material thickness in a range from approximately 0.4 mm.

The bifurcated contact 12 can also, for example, have a material thickness in a range from approximately 0.8 mm.

The electrically conductive jacket 18 therefore produces additional contact points to the mating contact 14 associated, for example, with a relay, a fuse or the like, without the constructional height being increased. Additional costs are correspondingly saved and the installation situation improved. The heat development in the central electrical system is reduced to a minimum and the current carrying capacity improved with the additional contact points to the mating contact or mating plug. The electrically conductive jacket 18 therefore represents an additional bridge between the mating contact 14 associated, for example, with a relay or a fuse and the current conductor 16.

The invention claimed is:

1. An electrical connection device comprising:

a bifurcated contact to establish an electrical connection with a mating contact;

the bifurcated contact having at least two limbs, at least one web region between said limbs, and an electrically conductive jacket that is in contact with said web region;

the bifurcated contact having a jacketed region wherein the jacket at least partially surrounds the two limbs and the jacket has an elongate section bent around free ends of the two limbs;

the two limbs providing a plurality of contact positions for contacting the mating contact within the jacketed region.

2. An electrical connection device in accordance with claim 1, wherein the jacket includes a plurality of shoulders, each shoulder being positioned proximate a free end of a corresponding limb.

3. An electrical connection device in accordance with claim 1, wherein the jacket comprises a copper plastic alloy.

4. An electrical connection device in accordance with claim 1, wherein the jacket is formed from a flat part having a material thickness of approximately 0.4 mm.

5. An electrical connection device in accordance with claim 1, wherein the bifurcated contact has a material thickness of approximately 0.8 mm.

6. An electrical connection device in accordance with claim 1, wherein the bifurcated contact is coupled to an electrical conductor.

7. An electrical connection device in accordance with claim 1, wherein the base section of the jacket extends beyond the web region of the bifurcated contact and at least partially covers a portion of the two limbs.

8. An electrical connection device in accordance with claim 7, wherein the base section of the jacket is formed so as to cover the web region of the bifurcated contact and to extend over the limbs, and wherein the elongate section is formed so as to cover free ends of the limbs.

9. An electrical connection device in accordance with claim 1, wherein the elongate section extends to a free end adjacent the web region of the bifurcated contact.

10. An electrical connection device in accordance with claim 9 wherein the base section of the jacket is bent laterally around the web region of the bifurcated contact to at least partly cover the free end of the elongate section.

11. An electrical connection device in accordance with claim 1, wherein the jacket includes shoulders that project from the jacket and into a gap between the limbs;

and wherein the shoulders are configured to receive the mating contact and to form contact positions with the mating contact.

12. An electrical connection device in accordance with claim 11, wherein the jacket defines an opening that is aligned with the gap between the limbs.

13. An electrical connection device in accordance with claim 11, wherein the jacket includes at least two shoulders, the at least two shoulders configured to contact the mating contact on opposite sides of the gap.

14. An electrical connection device in accordance with claim 13, wherein the shoulders are disposed on opposite sides of the opening.

15. An electrical connection device comprising:

a bifurcated contact to establish an electrical connection with a mating contact;

the bifurcated contact having at least two limbs, at least one web region between said limbs, and an electrically conductive jacket that is in contact with said web region;

the bifurcated contact having a jacketed region wherein the jacket at least partially surrounds the two limbs;

the two limbs providing a plurality of contact positions for contacting the mating contact within the jacketed region, wherein the jacket includes four shoulders that project from the jacket and into a gap between the limbs;

wherein the four shoulders are configured to receive the mating contact and to form contact positions with the mating contact;

wherein the jacket defines an opening that is aligned with the gap between the limbs;

wherein two of the four shoulders are disposed on one side of the opening, and wherein another two of the four shoulders are disposed on an opposite side of the opening.

16. An electrical connection device comprising:

a bifurcated contact to establish an electrical connection with a mating contact;

the bifurcated contact having at least two limbs, at least one web region between said limbs, and an electrically conductive jacket that is in contact with said web region;

the bifurcated contact having a jacketed region wherein the jacket at least partially surrounds the two limbs;

the two limbs providing a plurality of contact positions for contacting the mating contact within the jacketed region, wherein the jacket is formed from a slit flat part that includes a slitless base section and an elongate slit section extending from the slitless base section, wherein the elongate slit section is formed so as to cover free ends of the limbs of the bifurcated contact, and wherein the slitless base section is formed laterally so as to cover the web region of the bifurcated contact.

17. An electrical connection device in accordance with claim 16, wherein the jacket is formed from a stamped part.

18. An electrical connection device in accordance with claim 16, wherein the elongate slit section of the jacket covers free ends of the limbs of the bifurcated contact and extends into the web region of the bifurcated contact.

19. An electrical connection device in accordance with claim 18, wherein the slitless base section of the jacket is formed laterally so as to cover the web region of the bifurcated contact and to at least partly cover the region of the free end of the elongate slit section as said section covers free ends of the limbs of the bifurcated contact.

* * * * *